United States Patent [19]

Garfield

[11] 4,323,811

[45] Apr. 6, 1982

[54] STREAKING IMAGE TUBE WITH CLOSELY SPACED PHOTOCATHODE, SUPPRESSOR MESH, AND ACCELERATOR MESH

[75] Inventor: Brian R. C. Garfield, Essex, England

[73] Assignee: English Electric Valve Company Limited, Chelmsford, England

[21] Appl. No.: 89,205

[22] Filed: Oct. 29, 1979

Related U.S. Application Data

[63] Continuation of Ser. No. 885,192, Mar. 10, 1978, abandoned, which is a continuation of Ser. No. 599,465, Jul. 28, 1975, abandoned.

[30] Foreign Application Priority Data

Aug. 3, 1974 [GB] United Kingdom ..... 34304/74

[51] Int. Cl.[3] ..... H01J 31/26; H01J 39/04

[52] U.S. Cl. ..... 313/99; 250/213 VT

[58] Field of Search ..... 313/94, 99, 101, 102, 313/106, 382; 250/213 VT

[56] References Cited

U.S. PATENT DOCUMENTS

| | | | |
|---|---|---|---|
| 3,002,101 | 9/1961 | Anderson et al. | 250/213 VT |
| 3,136,916 | 6/1964 | Schaefer | 313/106 X |
| 3,395,303 | 7/1968 | Kajiyama | 313/106 X |
| 3,439,222 | 4/1969 | Driard et al. | 313/99 X |
| 3,761,614 | 9/1973 | Bradley | 356/226 |
| 3,775,636 | 11/1973 | McNally | 250/213 VT |

*Primary Examiner*—Robert Segal

*Attorney, Agent, or Firm*—Diller, Ramik & Wight

[57] ABSTRACT

A streaking image tube having a suppression mesh electrode spaced between the normally provided accelerating mesh electrode and anode. Appropriate potentials are applied to the electrodes so that undesirable secondary emission from the accelerating mesh electrode is returned to that said electrode.

7 Claims, 2 Drawing Figures

STREAKING IMAGE TUBE WITH CLOSELY SPACED PHOTOCATHODE, SUPPRESSOR MESH, AND ACCELERATOR MESH

CROSS REFERENCE TO RELATED APPLICATIONS

The above-entitled application is a Rule 60 continuation of Ser. No. 885,192, filed Mar. 10, 1978 and now abandoned; Ser. No. 885,192 being a rule 60 continuation of Ser. No. 599,465 filed July 28, 1975 and now abandoned.

This invention relates to electron optical image tubes of the type known as streaking or, alternatively as, framing image tubes, that is tubes used to provide a visible record—usually for measurement purposes—of high speed luminous events having extremely short durations e.g. in the picosecond range. It is to be understood that the term "streaking image tube" as used hereinafter is to include the term "framing image tube".

Figure 1:
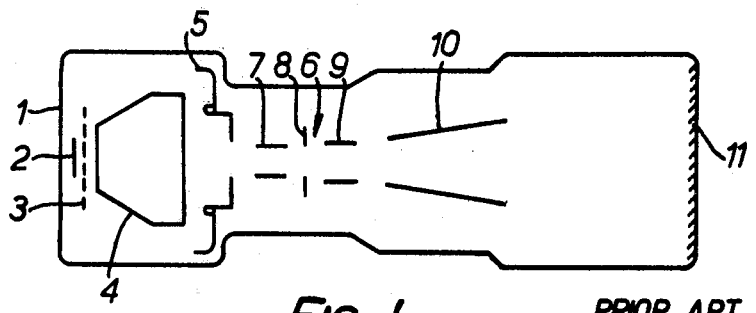
FIG. 1. PRIOR ART
Figure 2:
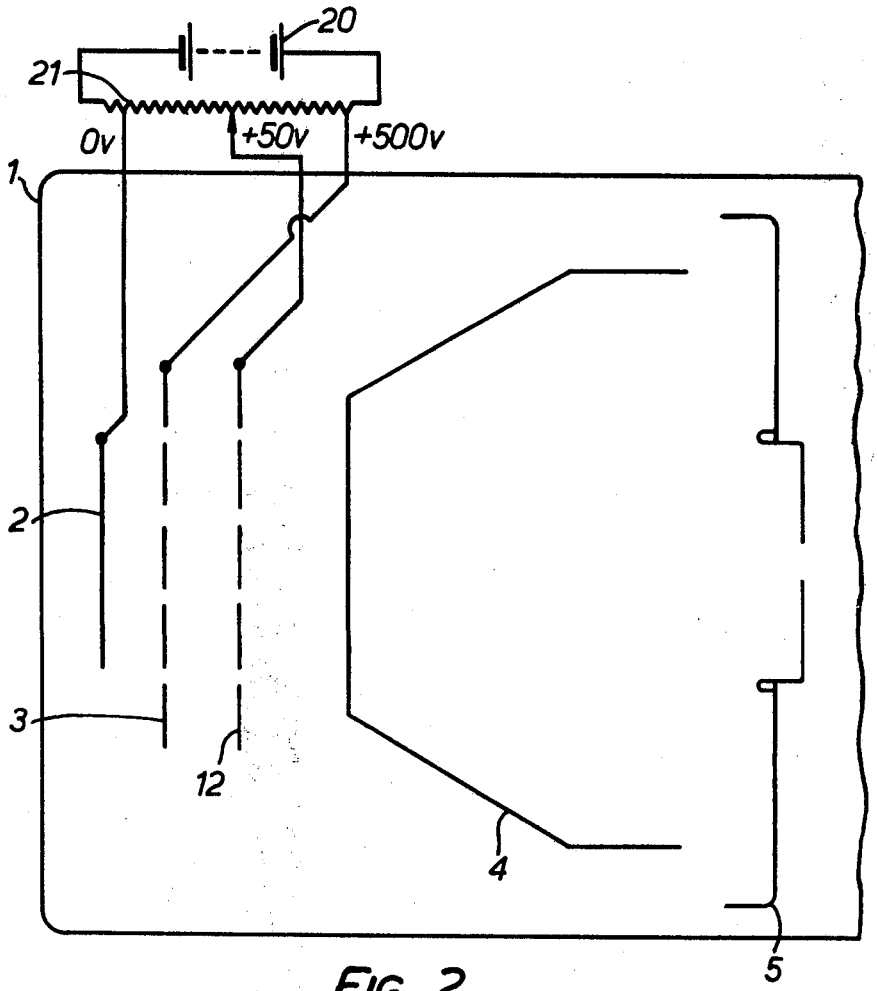

The accompanying FIG. 1 shows a known streaking image tube and FIG. 2 shows, by way of example, a part of a streaking image tube in accordance with this invention.

The known tube shown in FIG. 1 has, within a glass, evacuated, envelope 1, a photocathode 2 upon which light pulses of events to be recorded are focussed by means not shown. Electrons emitted by the photocathode 2 in response to the light pulses are accelerated by a positive potential of 500 v with respect to the photocathode 2 which potential is applied to an accelerating mesh electrode 3, the mesh electrode 3 being axially spaced from the photocathode 2 by approximately 3–4 mm and being manufactured from 500 mesh/inch copper material. The electrons thus accelerated are focussed by a conical focussing electrode 4 to pass through an anode 5, and a shutter 6 comprising deflecting plates 7, shutter aperture plate 8 and compensating deflector plates 9. The plates 7 may be provided with a transverse electric field so as to deflect the electron beam on to the plate 8 thereby cutting off the electron image and the plates 9 are provided for correcting undesired transverse beam movement. The electron beam then passes through a pair of sweep deflectors 10 which, in the FIG. 1, are shown orientated 90° from their practical position for ease of drawing and clarity, and across which a linear ramp voltage is applied to scan the electron beam on a phosphor screen 11. An electroluminescent image, substantially orthogonally disposed to the scanning beam, is thus formed on the screen 11 which may be utilised e.g. intensified and photographed, in any known manner.

Such a known tube suffers from the defect that the accelerating mesh electrode 3 is required to be operated at a voltage (500 v or possibly up to 1 KV) where the production of secondary emission tends to be highest. This degrades the image quality due to the lower energy of the secondary electrons which move towards the screen 11 at lower speeds to the primary electrons so lengthening the exposure time to cause blurring. Furthermore, it has been found possible for light energy to pass straight through the photocathode 2 and to produce spurious photoelectrons within the tube which are accelerated by the mesh 3 electrode and so provide another source of image degradation. Thus the time resolution of the tube is restricted because the shorter the time of a given event the greater will be that proportion of the image on the screen 11 due to the secondary electron blurring.

The present invention seeks to provide an improved streaking or framing image tube in which the foregoing defects are at least mitigated.

According to this invention a streaking or framing image tube includes a photocathode, an accelerating mesh electrode, an anode, and a further mesh electrode spaced between the anode and the accelerating mesh electrode the arrangement being such that during operation of the tube with suitable potentials applied to the electrodes, secondary electrons produced by the accelerating mesh electrode are attracted back to that electrode.

A tube in accordance with the invention will also tend to ensure that secondary electrons produced by the further mesh electrode are also attracted to the accelerating mesh electrode.

Preferably, the spacing of the accelerating mesh electrode from the photocathode is in the range 0.5 mm to 1 mm.

Preferably the accelerating mesh electrode and the further mesh electrode are substantially 500 mesh/inch and the spacing between the said electrodes is in the range 1.5 mm to 3.0 mm.

Advantageously the potential to be applied to the further mesh electrode is low relative to that potential to be applied to the accelerating mesh electrode so that, in operation, secondary emission from the further mesh electrode is relatively low.

Both the mesh electrodes may be produced from either copper or nickel material and advantageously the accelerating mesh electrode is coated with a low secondary emissive material such as carbon.

In FIG. 2 like parts to those parts shown in FIG. 1 have been given like reference numerals and it will be seen from FIG. 2 that it differs from FIG. 1 by the addition of a further suppression mesh electrode 12. The electrode 12 has substantially the same mesh as the accelerating mesh electrode 3 and is axially spaced therefrom by 2 mm, the spacing of the electrode 3 from the photocathode 2 being reduced to the order of 0.5 mm so as to improve primary electron extraction. The electrodes 3 and 12 may be produced from copper or nickel material.

In operation, typical operating potentials supplied, for the sake of simplification of explanation by a voltage source 20 and tapped resistance 21, are 0 v applied to the photocathode, +500 v applied to the accelerating electrode 3 and +50 v applied to the suppression mesh electrode 12. Thus most of the secondary electrons produced by the accelerating mesh electrode 3 and the suppression mesh electrode 12, and also the spurious photoelectrons having energies of only a few electron-volts are attracted back to the electrode 3. It will of course be realised that primary electrons produced by the photocathode 2 have sufficient energy to pass through the decelerating field produced by the suppression mesh electrode 12 to land on the screen 11, and it has been found that improved focussing of the electron beam results from retardation of the primary electrons. It will be evident to those skilled in the art that by decreasing the potential on the suppression mesh electrode 12 to below the photocathode 2 potential, as schematically indicated by the variable tapping on resistance 21, complete cut-off of the primary electron beam can be effected, i.e. the electrode 12 may be used as a gating electrode. Operating the suppression mesh electrode in the vicinity of +50 v has the added advantage that at these potentials secondary emission of the material is lower than at higher potentials.

As a further aid to secondary suppression the accelerating mesh electrode may be coated with a low secondary emissive material such as carbon.

I claim:

1. In a streaking image tube of the type including photocathode means for receiving light images of picosecond duration and converting them to photoelectrons, accelerating mesh electrode means immediately adjacent said photocathode means for accelerating the photoelectrons away from the photocathode means, anode means spaced from said accelerating mesh electrode means for passing said photoelectrons therethrough, a screen for receiving said photoelectrons, and deflection means disposed between said anode means and said screen for deflecting said photoelectrons normally to their direction of movement to form a streak image on said screen, the improvement wherein:

the spacing of said accelerating mesh electrode from said photocathode is in the range 0.5 mm to 1 mm, and wherein further mesh electrode means is provided immediately adjacent said accelerating mesh electrode means at a spacing of 1.5 to 3.0 mm therefrom, and between the same and said anode means for causing secondary electrons produced by said accelerating mesh electrode means and/or spurious photoelectrons caused by light energy passing through said photocathode means to be attracted to said accelerating mesh electrode means, whereby to enhance the quality of said streak image.

2. In a streaking image tube as defined in claim 1 wherein the spacing of said accelerating mesh electrode means from said photocathode means is in the range 0.5 mm to 1 mm.

3. In a streaking image tube as defined in claim 1 wherein said accelerating mesh electrode means and said further mesh electrode are substantially 500 mesh/inch.

4. In a streaking image tube as defined in claim 1 wherein said accelerating mesh electrode means and said further mesh electrode are produced from either copper or nickel material.

5. In a streaking image tube as defined in claim 1 wherein said accelerating mesh electrode means is coated with a low secondary emissive material.

6. In a streaking image tube as defined in claim 5 wherein said material is carbon.

7. In a streaking image tube of the type including photocathode means for receiving a light image which may be in the picosecond range and converting it to photoelectrons, accelerating mesh electrode means immediately adjacent said photocathode means for accelerating the photoelectrons away from the photocathode means, anode means spaced from the accelerating mesh electrode means for passing said photoelectrons therethrough, a screen spaced from said anode means for receiving said photoelectrons, and deflection means disposed between said anode and said screen for deflecting said photoelectrons normally to their direction of movement to form a streak image on said screen, the improvement which comprises:

a further mesh electrode immediately adjacent said accelerating mesh electrode means at a spacing of 1.5 to 3.0 mm therefrom, and between the same and said anode means, for causing secondary electrons produced by said accelerating mesh electrode means and/or spurious photoelectrons caused by light energy passing through said photocathode means to be attracted to said accelerating mesh electrode means, whereby said length of the streak image more accurately indicates said duration of the light image.

* * * * *